US008223977B2

(12) United States Patent
Watanabe

(10) Patent No.: US 8,223,977 B2
(45) Date of Patent: Jul. 17, 2012

(54) SOUND RECEIVER

(75) Inventor: Junichi Watanabe, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 882 days.

(21) Appl. No.: 11/892,920

(22) Filed: Aug. 28, 2007

(65) Prior Publication Data

US 2007/0297630 A1 Dec. 27, 2007

Related U.S. Application Data

(63) Continuation of application No. PCT/JP2005/003336, filed on Feb. 28, 2005.

(51) Int. Cl.

| | |
|---|---|
| ***H04R 5/00*** | (2006.01) |
| ***H04R 1/02*** | (2006.01) |
| ***H04R 9/08*** | (2006.01) |
| ***H04R 11/04*** | (2006.01) |
| ***E04B 1/82*** | (2006.01) |

(52) U.S. Cl. ..... 381/26; 381/91; 381/356; 181/284

(58) Field of Classification Search ..... 381/26, 381/91, 335, 122, 345, 355, 356, 357, 360, 381/369, 359; 379/433.03; 181/198, 199, 181/205, 284, 286, 288, 290, 293

See application file for complete search history.

(56) References Cited

U.S. PATENT DOCUMENTS

| | | | | |
|---|---|---|---|---|
| 1,678,842 | A * | 7/1928 | Aiken | 181/198 |
| 1,682,409 | A * | 8/1928 | Nyman | 381/352 |
| 2,346,394 | A * | 4/1944 | Rettinger | 181/198 |
| 3,110,769 | A * | 11/1963 | Bertram | 381/26 |
| 4,967,874 | A * | 11/1990 | Scalli | 381/354 |
| 5,709,053 | A | 1/1998 | Kuroda | |
| 5,808,243 | A * | 9/1998 | McCormick et al. | 181/198 |
| 6,237,302 | B1 * | 5/2001 | Fricke | 52/404.1 |
| 6,597,793 | B1 * | 7/2003 | Darbut et al. | 381/357 |
| 7,263,028 | B2 * | 8/2007 | Thomas et al. | 181/290 |
| 2008/0019551 | A1 | 1/2008 | Watanabe | |

FOREIGN PATENT DOCUMENTS

| | | |
|---|---|---|
| JP | 57-92240 | 6/1982 |
| JP | 61-117998 | 6/1986 |
| JP | 63-74896 | 5/1988 |
| JP | 9-238394 | 9/1997 |
| JP | 10-336777 | 12/1998 |
| JP | 2004-80173 | 3/2004 |

(Continued)

OTHER PUBLICATIONS

Morse, P.M. et al., *Theoretical Acoustics*, 1986, Princeton University Press, Princeton, New Jersey, XP002509956, pp. 441-466 (26 pp).

(Continued)

*Primary Examiner* — Jesse Elbin
(74) *Attorney, Agent, or Firm* — Staas & Halsey LLP

(57) ABSTRACT

Sound waves having a proper phase difference are received by microphones fixed in a mesh-formed casing, while other sound waves pass through the casing, and reach a front surface of a diffuse reflection member. The randomly uneven front surface of the diffuse reflection member diffusely reflects the sound waves, thereby preventing the reflected sound waves from reaching the microphones at the proper phase difference. Any reflected sound waves that do reach the microphones are received at a phase difference that is different from the proper phase difference and are determined to be noise by a sound-source determining circuit, thereby enabling a sound receiver to receive only sound waves having the proper phase difference, and hence, improving directivity thereof.

7 Claims, 5 Drawing Sheets

FOREIGN PATENT DOCUMENTS

| | | |
|---|---|---|
| JP | 2004-200836 | 7/2004 |
| JP | 2006-14196 | 1/2006 |
| WO | 95/32496 | 11/1995 |
| WO | WO 99/46956 | 9/1999 |
| WO | WO 2006/075377 | 7/2006 |

OTHER PUBLICATIONS

Supplementary European Search Report dated Jan. 23, 2009 in corresponding European Application No. 05719653.7 (4 pp).

International Preliminary Report on Patentability issued in corresponding International Application No. PCT/JP2005/003336, mailed on Sep. 20, 2007.

Japanese Patent Office Notice of Rejection mailed Feb. 1, 2011 for corresponding Japanese Patent Application No. 2007-505761.

Japanese Patent Office Notice of Rejection mailed Jun. 7, 2011, for corresponding Japanese Patent Application 2007-505761.

* cited by examiner

SOUND RECEIVER

CROSS-REFERENCE TO RELATED APPLICATIONS

This application is a continuation application of International Application PCT/JP2005/003336, filed Feb. 28, 2005.

BACKGROUND OF THE INVENTION

1. Field of the Invention

The present invention relates to a sound receiver and directivity thereof.

2. Description of the Related Art

Conventionally, a microphone device having directivity toward a specific speaker direction has been proposed (for example, refer to Japanese Patent Laid-Open Publication No. H9-238394) as a sound input device. This microphone device is a directional microphone in which multiple microphones are arranged on a plane, and outputs of respective microphones are added through a delay circuit, respectively, to obtain an output. A silence detection function acquires a ratio between a cross-correlation function of a predetermined range of time difference between output signals of the respective microphones and a cross-correlation function of a time difference between signals corresponding to set sound source positions, and makes voice and silence determination by detecting that there is a sound source at the set position when this ratio satisfies a predetermined threshold.

However, when the microphone device described above is set in a relatively small space such as a room, the microphone device is often set on a wall of the room or on a table. It is common knowledge that if the microphone device is thus set on a wall or a table, sound clarity is negatively affected by waves reflected from the wall or the table, and when the sound is recognized by a sound recognition system, there has been a problem of deterioration in recognition rate.

Moreover, although a boundary microphone device is engineered so as to receive only a sound wave directly from a speaker without receiving waves reflected from the wall or the like, when multiple boundary microphones are used to act as a microphone array device, there has been a problem in that the directivity is not sufficiently exerted due to individual variations originated in the complicated structure of the boundary microphone. Furthermore, when the microphone array device is mounted on a vehicle, since the space of the vehicle interior is small, the effect of the reflected waves is significant, and there has been a problem in that the directivity is not sufficiently exerted.

SUMMARY OF THE INVENTION

It is an object of the present invention to at least solve the above problems in the conventional technologies.

A sound receiver according to one aspect of the present invention includes a plurality of microphones that receive a first sound wave; a casing that supports the microphones and in which an opening is formed; and a diffuse reflection member that diffusely reflects a second sound wave that has passed through the opening of the casing.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Referring to the accompanying drawings, exemplary embodiments according to the present invention are explained in detail below.

Figure 1:
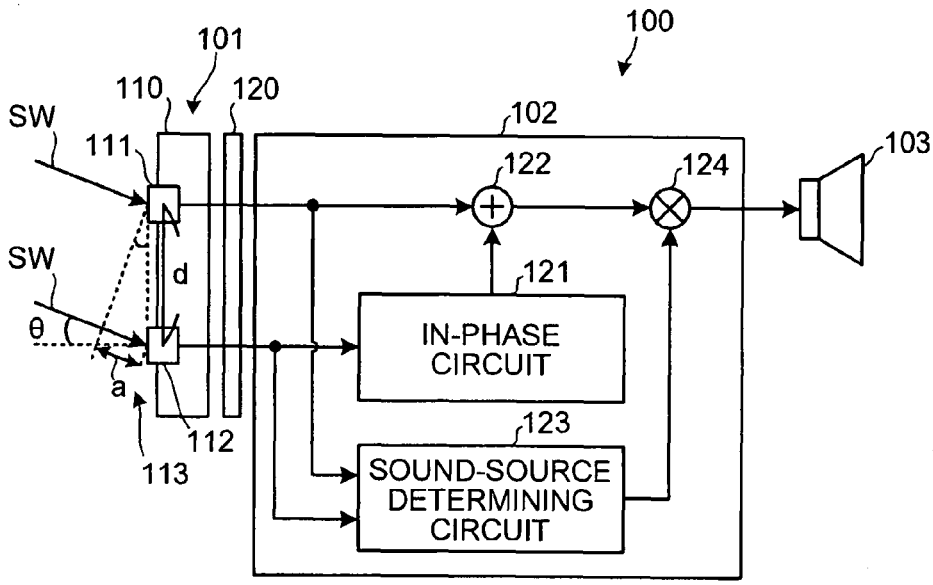
FIG. 1 is a block diagram of a sound processing device that includes a sound receiver according to a first embodiment of the present invention.

FIG. 1 is a block diagram of the sound processing device that includes the sound receiver according to the first embodiment of the present invention. As shown in FIG. 1, a sound processing device 100 includes a sound receiver 101, a signal processing unit 102, and a speaker 103.

The sound receiver 101 is constituted of a casing 110, a microphone array 113 that includes multiple (two in the example shown in FIG. 2 for simplification) microphones 111 and 112, and a diffuse reflection member. The microphones 111 and 112 are arranged maintaining a predetermined distance d. The microphone array 113 receives a sound wave SW coming from an external source at a predetermined phase difference. Specifically, there is a time difference T ($\tau=a/c$, where c is the speed of sound) that is shifted in time by an amount corresponding to a distance a ($a=d\cdot\sin\theta$).

The signal processing unit 102 estimates sound from a target sound source based on an output signal from the microphone array 113. Specifically, for example, the signal processing unit 102 includes, as a basic configuration, an in-phase circuit 121, an adder circuit 122, a sound-source determining circuit 123, and a multiplier circuit 124. The in-phase circuit 121 makes an output signal from the microphone 112 in phase with an output signal from the microphone 111. The adder circuit 122 adds the output signal from the microphone 111 and an output signal from the in-phase circuit 121.

The sound-source determining unit 123 determines a sound source based on the output signal from the microphone array 113, and outputs a determination result of 1 bit (when "1", a target sound source; when "0", a non-target sound source). The multiplier circuit 124 multiplies an output signal from the adder circuit 122 and a determination result from the sound-source determining unit 123. Moreover, the speaker 103 outputs a sound signal that is estimated by the signal processing unit 102, in other words, sound corresponding to an output signal from the multiplier circuit 124.

Figure 2:
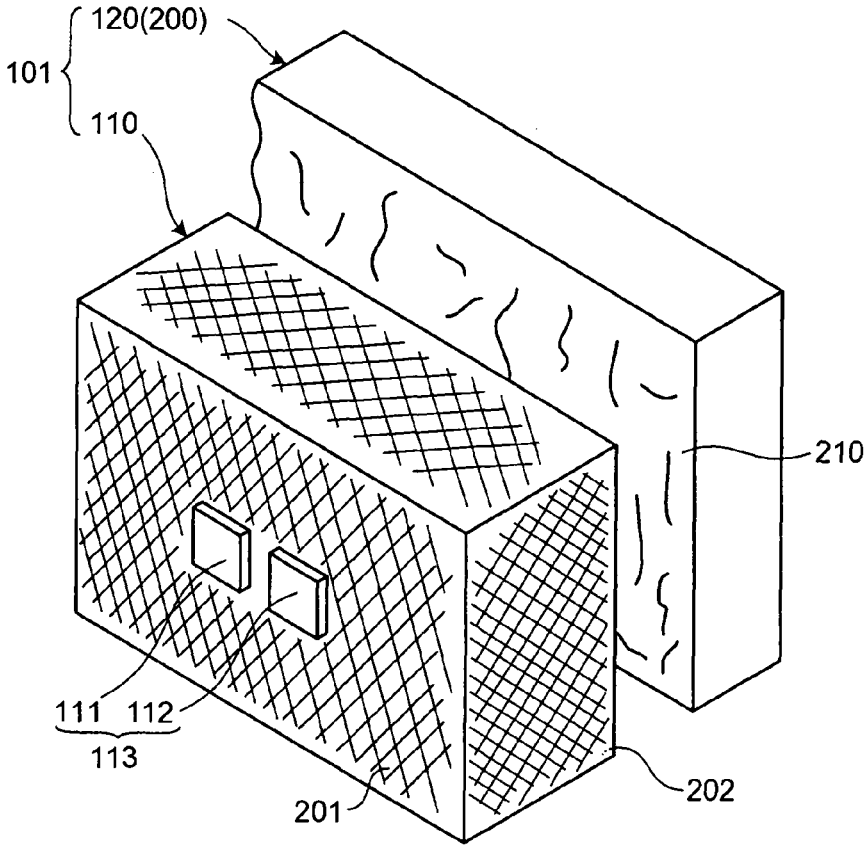
FIG. 2 is an external perspective view of the sound receiver according to a first example.

FIG. 2 is an external perspective view of the sound receiver 101 according to the first example. In the first example, a diffuse reflection member 200 that is formed with a planar resin sheet is used as the diffuse reflection member 120. As shown in FIG. 2, the casing 110 of the sound receiver 101 is formed in, for example, a rectangular parallelepiped, and openings are formed. The casing 110, each surface thereof having a mesh formation that forms numerous openings in the casing 110, has a configuration that does not affect the sound wave.

In other words, with a mesh formation of the casing 110, sound waves are not reflected by inner walls of the casing 110, but rather pass (penetrate) through the casing 110. Therefore, no reflected sound waves of the casing 110 are received by the microphone array 113. The casing is not limited to a mesh form, and can be in a lattice form. Moreover, the microphone array 113 is supported at a front surface 201 of the casing 110.

Furthermore, the diffuse reflection member 200 is arranged on a side of a rear surface 202 of the casing 110. The diffuse reflection member 200 is a resin sheet formed in a planar shape. A front surface 210 of the diffuse reflection member 200 is formed in a randomly uneven configuration. The front surface 210 faces the rear surface 202 of the casing 110 keeping a predetermined distance. The front surface 210 and the rear surface 202 can be arranged to abut each other. The diffuse reflection member 200 is formed with a material such as silicon rubber, acrylic, polyvinyl alcohol (PVA) gel, and the like.

Figure 3:
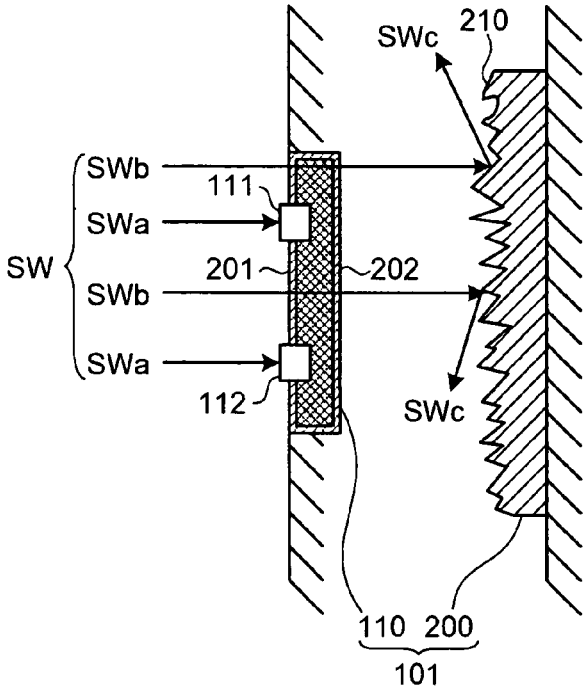
FIG. 3 is a cross-section of the sound receiver shown in FIG. 2.

FIG. 3 is a cross-section of the sound receiver 101 shown in FIG. 2 when viewed from the top. In the example shown in FIG. 3, sound waves SWa among sound waves SW are received by the microphones 111 and 112 at the predetermined phase difference. On the other hand, sound waves SWb pass through the casing 110 having a mesh form and reach the front surface 210 of the diffuse reflection member 200. Since the front surface 210 has a randomly uneven surface, the front surface 210 diffuses (diffusely reflects) the sound waves SWb, disarranging the phase difference thereof.

Therefore, reflected sound waves SWc do not reach the microphones 111 and 112 at a proper phase difference. Even if reflected sound waves SWc reach the microphones 111 and 112, the reflected sound waves SWc are received by the microphones 111 and 112 at a phase difference that is different from the phase difference of the sound waves SWa, and are determined to be noise by the sound-source determining circuit 123 shown in FIG. 1. Therefore, according to the sound receiver 101 of the first example, only the sound waves SWa having a proper phase difference can be received, and the directivity can be improved.

Figure 4:
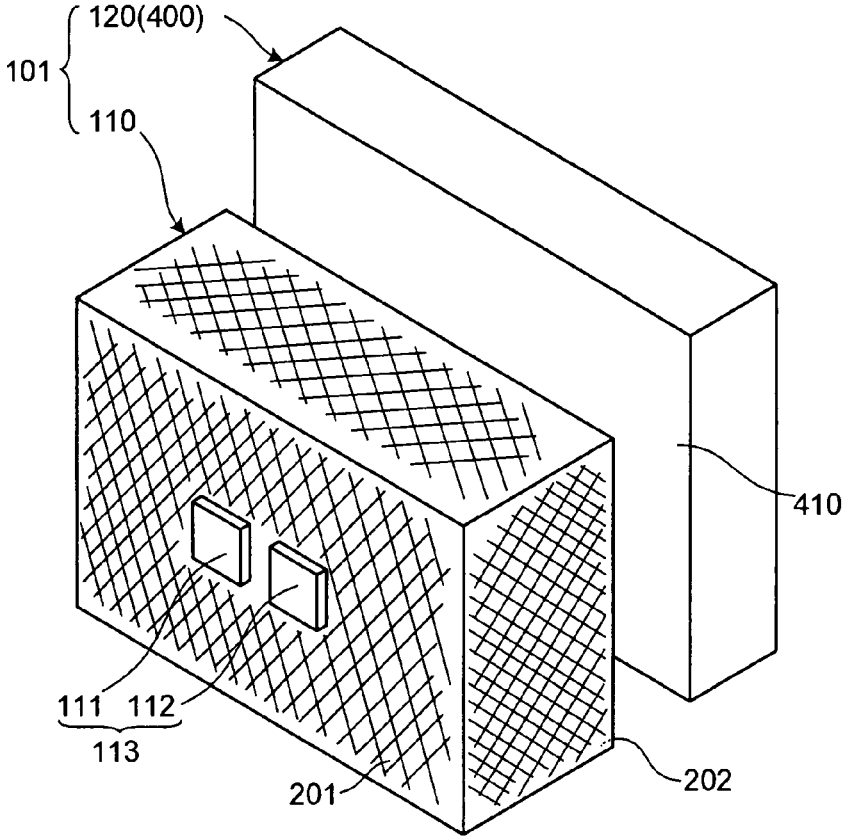
FIG. 4 is an external view of a sound receiver according to a second example.

FIG. 4 is an external view of the sound receiver according to the second example. The microphone array 113 and the casing 110 have the same configuration as those of the first example, and explanation thereof is omitted. As shown in FIG. 4, a diffuse reflection member 400 is arranged on a side of the rear surface 202 of the casing 110, similarly to the diffuse reflection member 200 of the first example. The diffuse reflection member 400 is a resin sheet formed in a planar shape. Moreover, the diffuse reflection member 400 is formed with a material such as silicon rubber, acrylic, PVA gel, and the like. The PVA gel is such a gel material that makes a propagation speed of a sound wave slower than that in air. A front surface 410 of the diffuse reflection member 400 is a flat surface.

Figure 5:
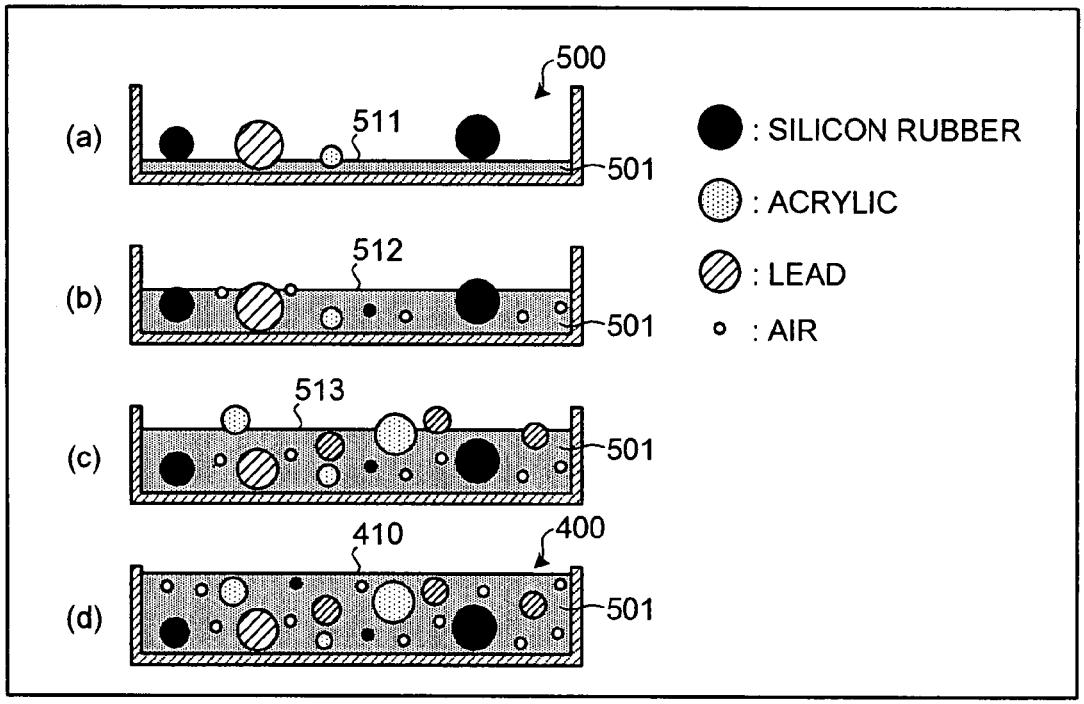
FIG. 5 is a process diagram showing a manufacturing method of a diffuse reflection member according to the second example.

FIG. 5 is a process diagram showing the manufacturing method of the diffuse reflection member 400 according to the second example. As shown in (a) of FIG. 5, first, a small quantity of a PVA gel 501 is put in a container 500 and is coagulated at the bottom. On a surface 511 of the coagulated PVA gel 501, spherical diffuse reflection materials are placed. The diffuse reflection materials are preferable to be materials that do not dissolve each other. Therefore, for example, materials such as silicon rubber, acrylic, lead, and the like are suitable for the diffuse reflection materials.

Next, as shown in (b), the PVA gel 501 is further put on the surface 511 of the PVA gel 501 coagulated at (a), and coagulated. When the PVA gel 501 is put on the surface 511, air is contained in the PVA gel 501. This air also acts as the diffuse reflection material. Therefore, it is possible to manufacture without concerning about the mixing of air. Thereafter, on a surface 512 of the coagulated PVA gel 501, the spherical diffuse reflection materials (silicon rubber, acrylic, lead) are placed.

Furthermore, as shown in (c), the PVA gel 501 is further put on the surface 512 of the PVA gel 501 coagulated at (b), and coagulated. When the PVA gel 501 is put on the surface 512, air is contained in the PVA gel 501. On a surface 513 of the coagulated PVA gel 501, the spherical diffuse reflection materials (silicon rubber, acrylic, lead) are further placed.

Finally, as shown in (d), the PVA gel 501 is further put on the surface 513 of the PVA gel 501 coagulated at (c) so as to embed and fix the spherical materials. Thus, the diffuse reflection member 400 that randomly contains a plurality of the diffuse reflection materials causing diffuse reflection can be manufactured. The embedded diffuse reflection materials do not have to be spherical.

Figure 6:
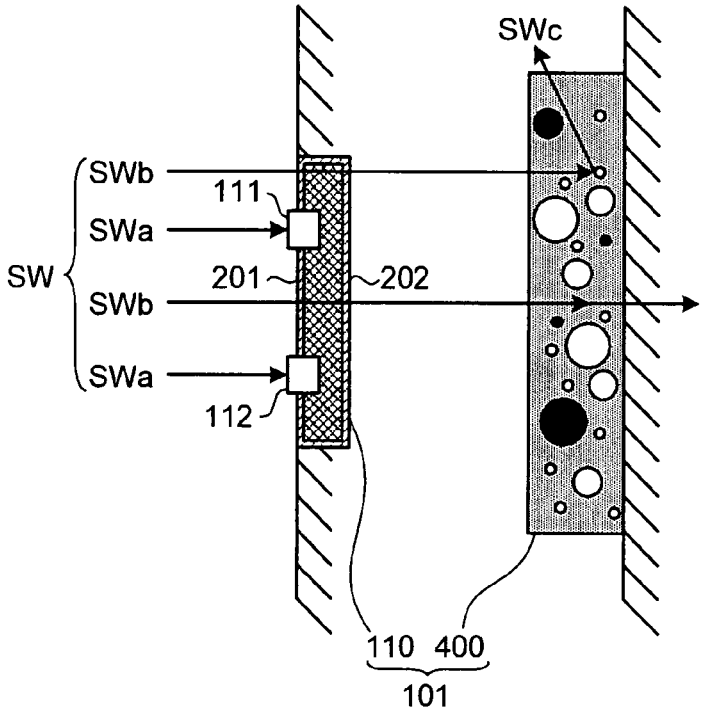
FIG. 6 is a cross-section of the sound receiver shown in FIG. 4.

FIG. 6 is a cross-section of the sound receiver 101 shown in FIG. 4 when viewed from top. In the example shown in FIG. 6, the sound waves SWa among the sound waves SW are received by the microphones 111 and 112. On the other hand, the sound waves SWb pass through the casing 110 having a net form and reach the front surface 410 of the diffuse reflection member 400. The sound waves SWb that reach the front surface 410 enter the diffuse reflection member 400, are diffused (diffusely reflected) by the diffuse reflection materials (silicon rubber, acrylic, lead) and air inside, and the phase difference thereof is disarranged, or the sound waves SWb pass through the diffuse reflection material 400.

Therefore, the sound waves SWb that have passed through the casing 110 and the reflected sound waves SWc from the diffuse reflection material 400 do not reach the microphones 111 and 112 at a proper phase difference. Even if the microphones 111 and 112 are reached, the sound waves SWb and the reflected sound waves SWc are received by the microphones 111 and 112 at a phase difference that is different from the phase difference of the sound waves SWa, and are determined to be noise by the sound-source determining circuit 123 shown in FIG. 1. Therefore, according to the sound receiver 101 of the second example also, only the sound waves SWa having a proper phase difference can be received, and the directivity can be improved.

Figure 7:
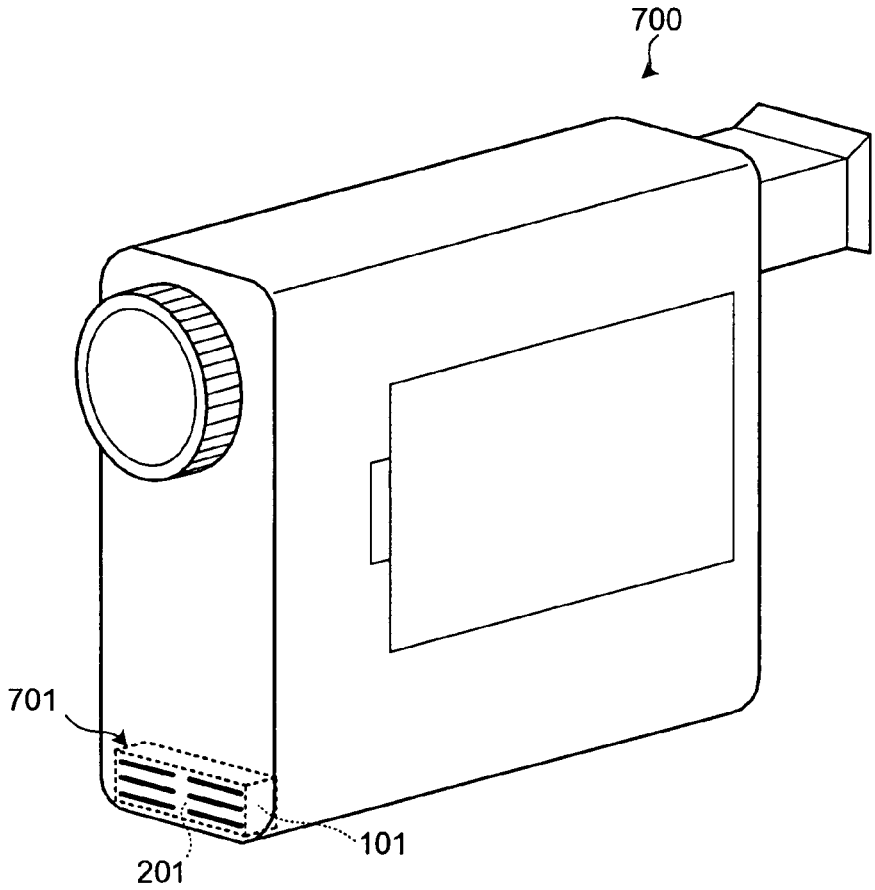
FIG. 7 illustrates an application of the sound receiver according to the embodiments to a video camera.
Figure 8:
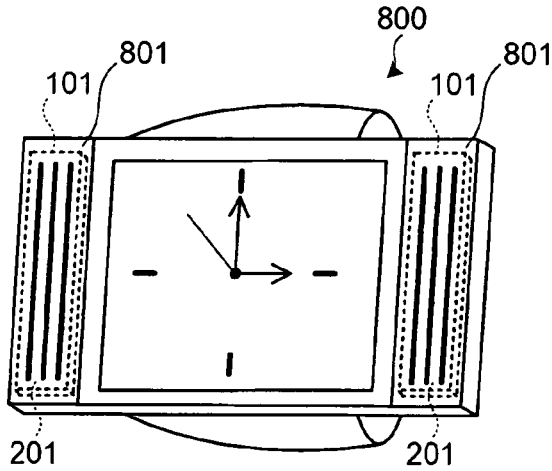
FIG. 8 illustrates an application of the sound receiver according to the embodiments to a watch.
Figure 9:
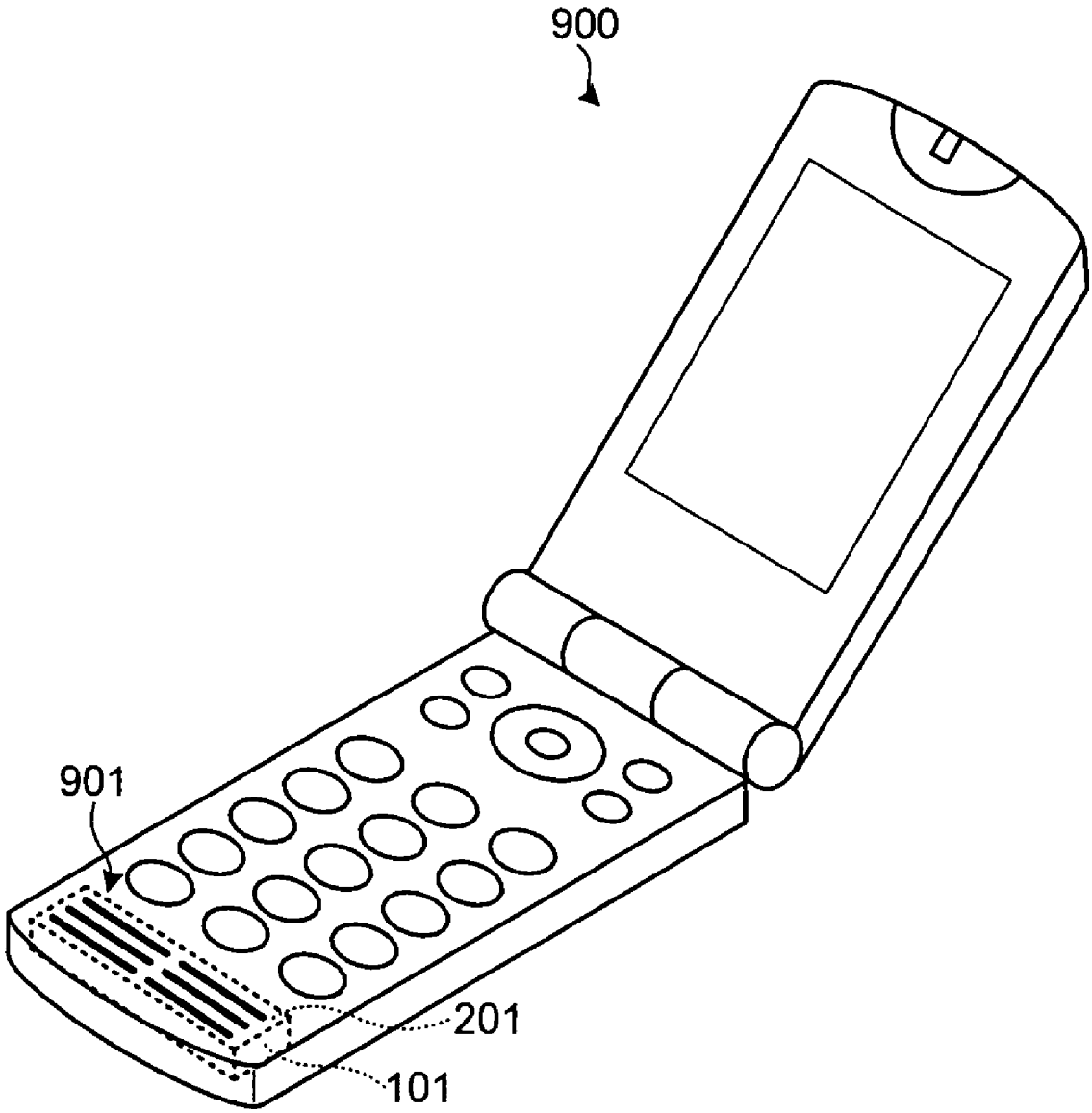
FIG. 9 illustrates an application of the sound receiver according to the embodiments to a mobile telephone.

FIG. 7 to FIG. 9 are diagrams illustrating application examples of the sound receiver according to the embodiments of the present invention. FIG. 7 illustrates an example of application to a video camera. The sound receiver 101 is built in a video camera 700, and abuts the front surface 201 and a slit plate 701.

Moreover, FIG. 8 illustrates an example of application to a watch. The sound receivers 101 are built in a watch 800 on the right and left sides of a watch face thereof, and abut the front surfaces 201 and slit plates 801, respectively. Furthermore, FIG. 9 illustrates an example of application to a mobile telephone. The sound receiver 101 is built in a mobile telephone 900 at a mouthpiece, and abuts the front surface 201 and a slip plate 901. Thus, it is possible to accurately receive a sound wave from a target sound source. Moreover, other than the examples shown, the sound receiver 110 can be applied to, for example, a sound recognition device of a navigation system for vehicles, and can be arranged on the surface of a wall near a driver seat, or can be embedded in a wall.

As described above, in the embodiments according to the present invention, only a sound wave that directly reaches a microphone is received at a proper phase difference, and reception of a reflected sound wave is prevented, thereby effecting a sound wave from a target sound source to be accurately received, and implementation of a sound receiver in which directivity of a microphone array is high. Furthermore, a phase difference of a sound wave from an undesirable direction is disarranged with a simple configuration, thereby effecting a sound wave from a target sound source to be accurately detected, and implementation of a sound receiver having high directivity.

While in the embodiments described above, the microphones 111 and 112 are arranged in a line, the microphones 111 and 112 can be two-dimensionally arranged according to an environment or a device to which the sound receiver 101 is applied. Furthermore, the microphones 111 and 112 used in the embodiments are desirable to be non-directional microphones, thereby enabling provision of a low-cost sound receiver.

As explained above, according to the embodiments described above, improved directivity of a sound receiver be can effected by a simple configuration.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A sound receiver comprising:

a plurality of microphones that receive a first sound wave;

a casing that has surfaces each of which has a mesh formation or a lattice formation that forms numerous openings in the casing and one of which supports the microphones; and a diffuse reflection member that diffusely reflects a second sound wave that has passed through the openings of the casing, wherein the casing is sandwiched by the microphones and the diffuse reflection member.

2. The sound receiver according to claim 1, wherein an incident surface of the diffuse reflection member hit by the second sound wave has a randomly uneven configuration.

3. The sound receiver according to claim 1, wherein the diffuse reflection member is configured to have randomly thereinside a plurality of diffuse reflection materials that diffusely reflect the second sound wave.

4. The sound receiver according to claim 3, wherein the diffuse reflection materials are materials that differ in hardness.

5. The sound receiver according to claim 4, wherein the diffuse reflection materials are materials that are non-reactive with each other.

6. The sound receiver according to claim 1, wherein the diffuse reflection member is configured to have thereinside a gel material that makes a propagation speed of the second sound wave slower than that in air.

7. The sound receiver according to claim 1, wherein the diffuse reflection member is formed with silicon rubber, acrylic, or polyvinyl alcohol (PVA) gel.

* * * * *